US005365873A

United States Patent [19]

Wigram

[11] Patent Number: 5,365,873

[45] Date of Patent: Nov. 22, 1994

[54] HYDROSTATIC PRESSURE SENSORS

[75] Inventor: Richard I. Wigram, Fleet, England

[73] Assignee: Smiths Industries Public Limited Company, London, England

[21] Appl. No.: 139,153

[22] Filed: Oct. 21, 1993

[30] Foreign Application Priority Data

Nov. 4, 1992 [GB] United Kingdom ..... 9223097

[51] Int. Cl.[5] ..... B63B 23/70

[52] U.S. Cl. ..... 114/367; 441/10

[58] Field of Search ..... 441/7, 10; 114/323-326, 367, 221 A; 403/31, 32

[56] References Cited

U.S. PATENT DOCUMENTS 2,360,848 10/1944 Bryant ..... 114/367
4,690,091 9/1987 Persbeck ..... 441/7 X

FOREIGN PATENT DOCUMENTS 0198805 10/1986 European Pat. Off. .
1276188 6/1972 United Kingdom ..... 114/367
2051212 1/1981 United Kingdom ..... 441/10
9116233 10/1991 WIPO .
92/09473 6/1992 WIPO .

*Primary Examiner*—Sherman Basinger
*Attorney, Agent, or Firm*—Pollock, VandeSande and Priddy

[57] ABSTRACT

A hydrostatic pressure release for releasing a life raft or the like when a ship sinks has a flexible diaphragm sealing a chamber on one side and exposed externally on its opposite side. A ceramic vent plug is mounted on the diaphragm so that it is protected within the casing of the device. The diaphragm has a resilient plate with an integral sleeve that projects through a collar in a rigid disc mounted on the plate. The plug is retained within the sleeve, in the collar. A rod projecting from the diaphragm extends into one end of an aperture in a slider and locks it in position. When the device is submerged, the diaphragm is deflected and pulls the rod out of the aperture allowing the slider to be released. A button on the slider extends into the other end of the aperture so that when is is depressed it pushes the rod out of the aperture and releases the slider.

9 Claims, 4 Drawing Sheets

Fig.7
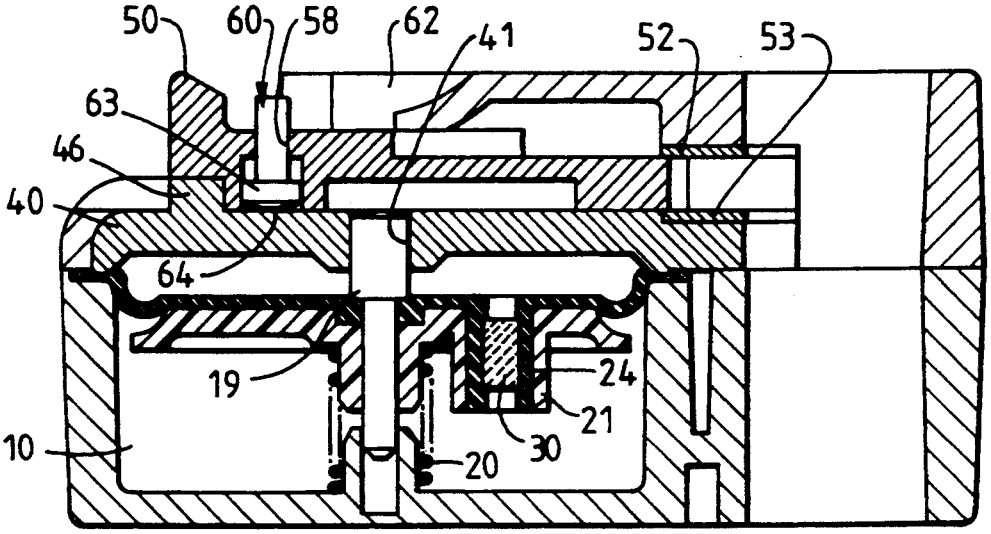
Fig.8
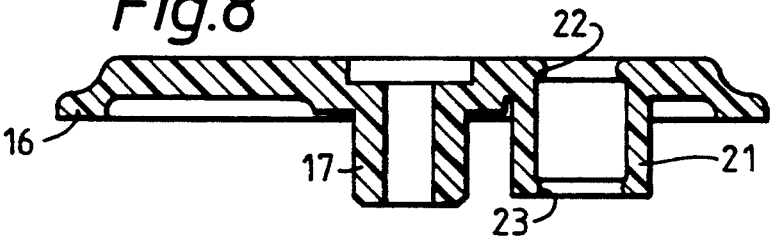
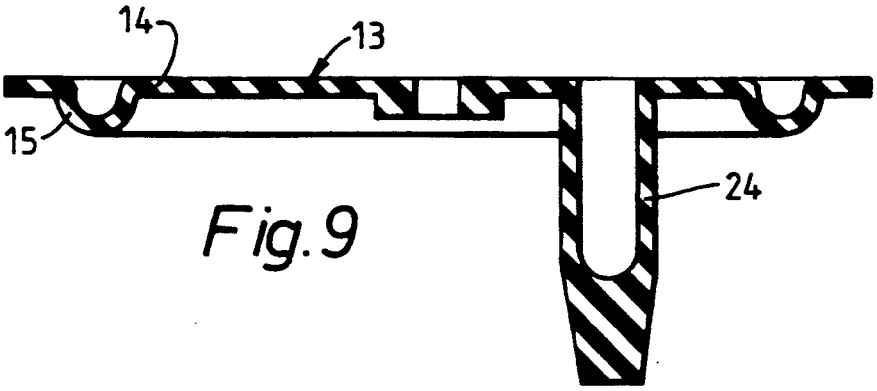
Fig.9

HYDROSTATIC PRESSURE SENSORS

BACKGROUND OF THE INVENTION

This invention relates to hydrostatic pressure sensors and other pressure-responsive devices.

The invention is more particularly concerned with hydrostatic release assemblies.

Hydrostatic release assemblies are used on marine vessels to release life rafts, position indicating radio beacons or the like automatically when the vessels sinks. The release assemblies usually have a pressure-sensing mechanism triggered by pressure at a certain depth of water. The assembly may have a spring-loaded knife blade released by pressure to cut a rope securing the life raft or other item of safety equipment on the vessel. Alternatively, the release may have a catch retaining a bolt, the catch being released at depth to allow withdrawal of the bolt.

The release mechanism usually includes a flexible diaphragm enclosing a sealed chamber, so that, as pressure increases, the diaphragm is pushed into the chamber and this movement is used to trigger the release. In order to prevent atmospheric pressure changes triggering the mechanism, a vent is used to allow a small flow of air into and out of the sealed chamber. In this way, pressure on opposite sides of the diaphragm is gradually equalized but a sudden change in pressure, caused by sinking in water, will still cause deflection of the diaphragm. Also, although air can flow through the vent, it will cause a considerably greater barrier to the flow of water.

Examples of hydrostatic release assemblies are described in WO 91/16233 and EP 0198805.

The hydrostatic release assembly is a critical part of the safety equipment of a vessel. If it releases too readily, the safety equipment may be lost overboard; if it fails to release, the safety equipment will go down with the vessel. The hydrostatic release assembly is often exposed to the environment since the equipment to be released must be located in a position where it can float free of the vessel. As such, the hydrostatic release assembly must be capable of withstanding harsh weather, rough handling and contamination by the various materials used aboard vessels. It is also desirable that the release assembly can be readily removed to enable servicing of the associated equipment and so that the operation of the release assembly can be checked.

PRESENT SUMMARY OF THE PRESENT INVENTION

It is an object of the present invention to provide an improved form of pressure-responsive device and hydrostatic release assembly.

According to one aspect of the present invention there is provided a pressure-responsive device including an outer casing, a chamber within the casing, a flexible diaphragm sealing the chamber on one side and exposed to pressure externally of the device on its opposite side, and pressure-equalizing vent means that allows gradual equalization of gas pressure between the chamber and the external environment, the vent means being in the form of a rigid cylindrical plug that is porous to gas and the plug being retained in a hole through a wall of the chamber by a resilient sleeve extending around the plug and within the hole.

The hole is preferably a hole through the diaphragm, the vent means being mounted on the diaphragm so that it is protected by the outer casing. The resilient sleeve is preferably a part of the diaphragm and the diaphragm preferably comprises a rigid disc mounted on a resilient plate, the disc being formed with a projecting collar within which the resilient sleeve extends. The sleeve may have an annular bead at each end. The rigid plug is preferably of a ceramic material. The resilient sleeve may be formed with a closed end that is cut off after it has been pulled through the hole.

The diaphragm is preferably arranged such that a sudden change in external pressure causes deflection of the diaphragm from a first position to a second position along an axis normal to the diaphragm, the device including slider means that is displaceable in a plane transverse to the axis, a retaining member coupled with the diaphragm for retaining the slider in a first position while the diaphragm is in the first position, means for urging the slider means to a second position different from the first position, the retaining member being operable to release the slider means for displacement to the second position when the diaphragm is displaced to the second position, and manually-actuable means that is operable to displace the retaining member to allow the slider means to move to the second position.

A pressure-responsive device in the form of a hydrostatic release assembly for a marine vessel, will now be described, by way of example, with reference to the accompanying drawings, in which:

BRIEF DESCRIPTION OF THE DRAWINGS

FIG. 7 is a sectional side elevation along the line VI—VI showing the release assembly in a released state;

FIG. 8 is a sectional side elevation through a part of the assembly, to a larger scale; and FIG. 9 is a sectional side elevation through a different part of the assembly, to a larger scale.

DESCRIPTION OF THE PREFERRED EMBODIMENT

Figure 1:
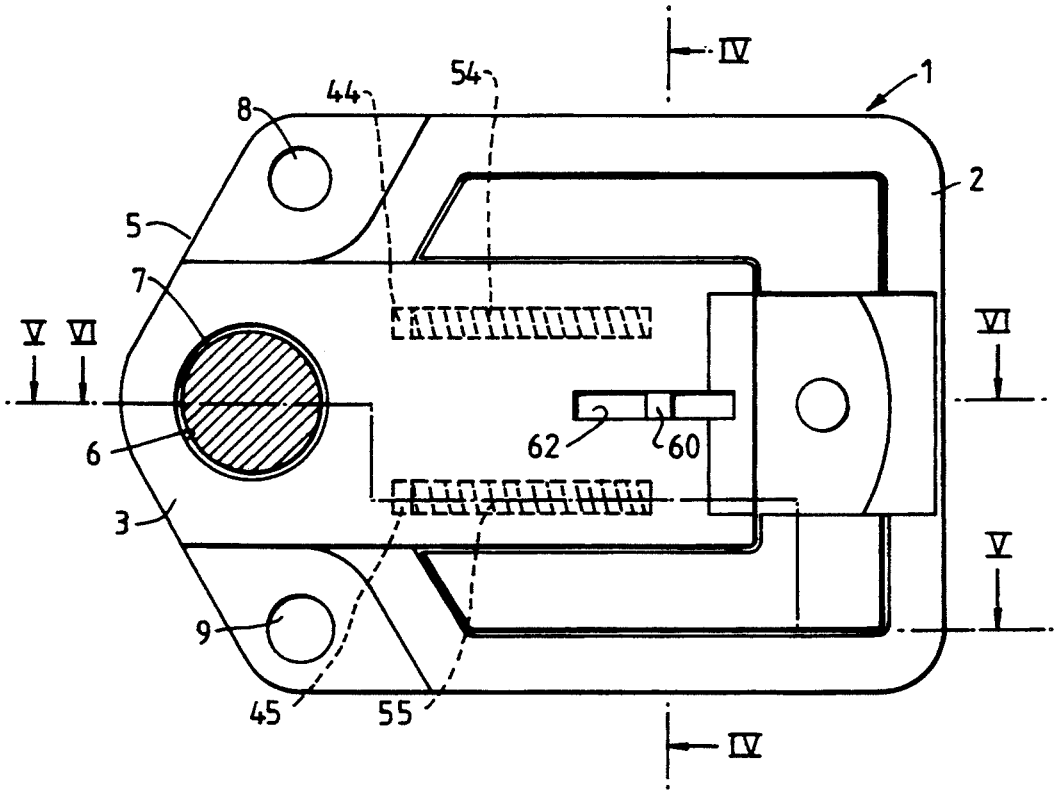
FIG. 1 is a plan view of the release assembly.
Figure 2:
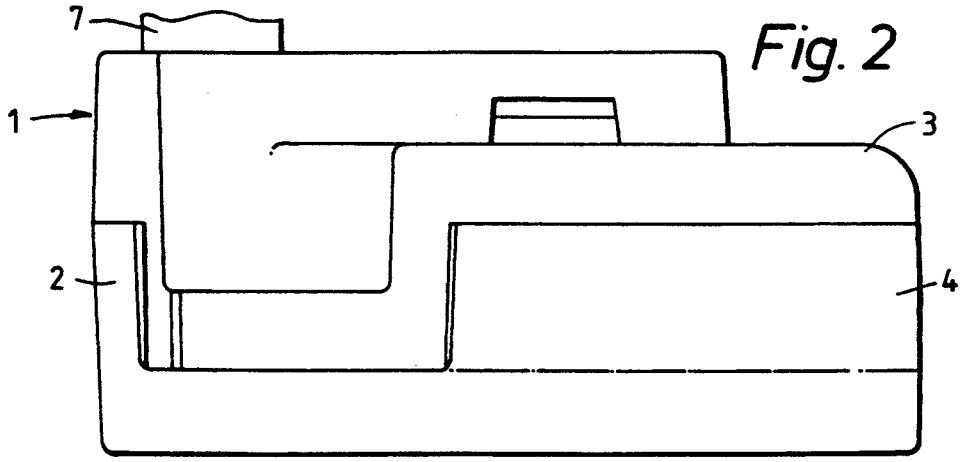
FIG. 2 is a side elevation of the assembly.
Figure 3:
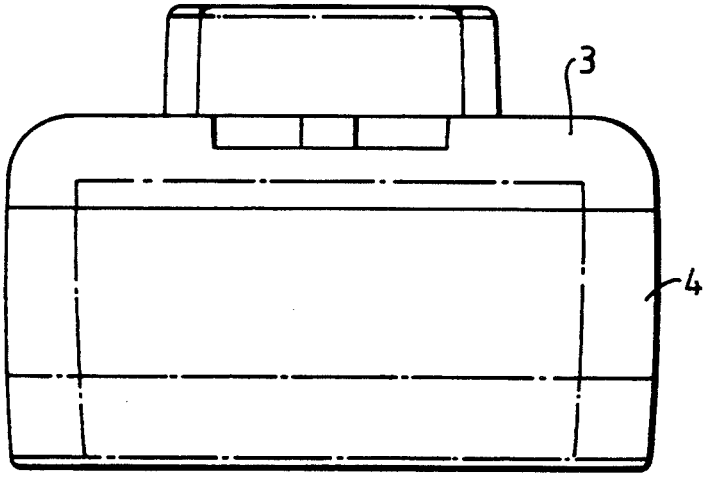
FIG. 3 is a view of the assembly from the right-hand end.

The hydrostatic pressure-responsive device or release assembly 1 includes an outer rigid plastics casing 2 formed of an upper moulding 3 and a lower moulding 4. The casing 2 is of generally rectangular shape with a V-shape left-hand end 5 having a centrally-located aperture 6 extending vertically through the assembly to receive a cylindrical bolt 7. The bolt 7 is attached to a life raft, an EPIRB (emergency position indicating radio beacon) or some other safety equipment to be released when the vessel sinks. The casing has two bolt holes 8 and 9 by which the assembly can be secured to a fixed part of the vessel.

The lower part 4 of the casing 2 has a pressure-sensing chamber 10 of circular section. A vertically-projecting, hollow spigot 12 formed as a part of the lower moulding 4 is located centrally on the floor 11 of the chamber. The upper end of the chamber 10 is sealed by a diaphragm assembly 13. The diaphragm assembly 13 comprises a flat, circular diaphragm plate 14, about 60 mm in diameter, and of silicone rubber which has a U-shape annular bead 15 extending around the plate just within the periphery of the chamber 10 and projecting inwardly of the chamber. The plate 14 carries on its lower surface a rigid plastics disc 16 of circular shape and with a diameter slightly smaller than that of the chamber 10. A hollow spigot 17 projects vertically down in the center of the disc 16 in alignment with the other spigot 12. The spigot 17 retains a metal rod 18 within it, which projects down as a sliding fit into the bore of the spigot 12. At its upper end, the rod 18 projects above the diaphragm plate 14 and is formed with a cylindrical enlargement providing a retaining member 19. A helical coiled spring 20 extends vertically between the floor 11 of the chamber 10 and the lower surface of the disc 16, the upper and lower ends of the spring embracing the spigots 17 and 12 respectively so that the diaphragm assembly 13 is urged upwardly.

The support disc 16 is also formed with a short vertically-depending collar 21 located off-center and projecting down into the chamber 10. The collar 21 is shown in greater detail in FIG. 8 and is formed with shallow internal annular beads 22 and 23, about 0.2 mm high, a its upper and lower ends. A sleeve 24 formed as a part of the resilient material of the diaphragm plate 14 projects downwardly within the collar 21. The collar 21 and sleeve 24 together serve to support a pressure-equalizing, gas vent plug 30 in the form of a cylindrical ceramic element, such as an extruded porcelain with a pore size of 1–3 $\mu$ of the kind sold by Fairey Dynamics Limited under code number B9L. The plug 30 has a diameter of 4 mm, the internal diameter of the collar 21 being 5.5 mm and the natural external diameter of the sleeve 24 being 6 mm, so that the wall of the sleeve is compressed between the plug 30 and inside of the collar. Prior to assembly, the sleeve 24 is about 19 mm long and has an externally-tapered, closed lower end, as shown in FIG. 9. The plug 30 is pushed into the sleeve 24, and the tapered end of the sleeve is then used to guide insertion of the sleeve into the collar. The sleeve 24, with the plug 30 in place, is pushed and pulled through the collar by gripping its tapered end so that it stretches into position. When the lower surface of the diaphragm plate 14 has been pulled into contact with the upper surface of the disc 16, and the plug 30 has been pulled into the collar 21 between the two beads 22 and 23, the closed end of the sleeve 24 is cut off close to the collar 21, so as to expose the end of the plug to the interior of the chamber 10. Mounting The plug in this way avoids the need to use adhesives or potting compounds, which could impair venting operation if they were to contact the end surfaces of the plug and thereby prevent gas flow along the plug.

Figure 4:
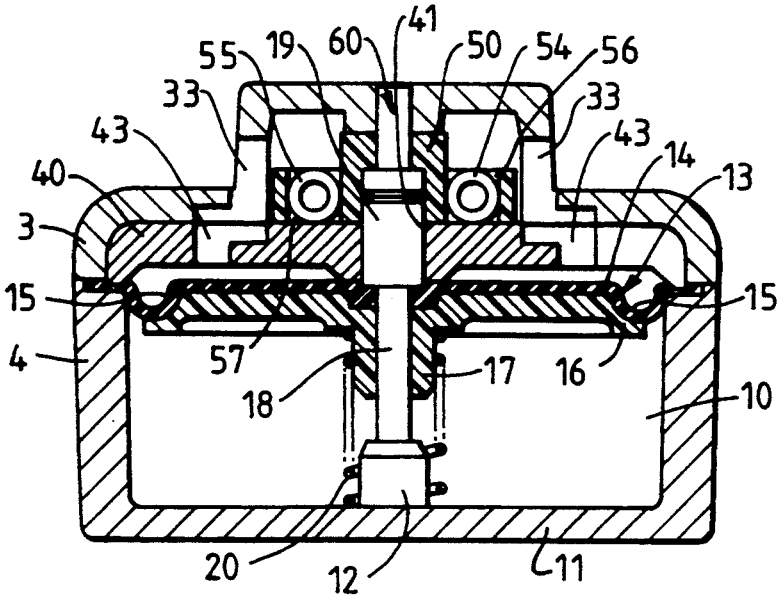
FIG. 4 is a transverse section along the line IV—IV of FIG. 1.
Figure 5:
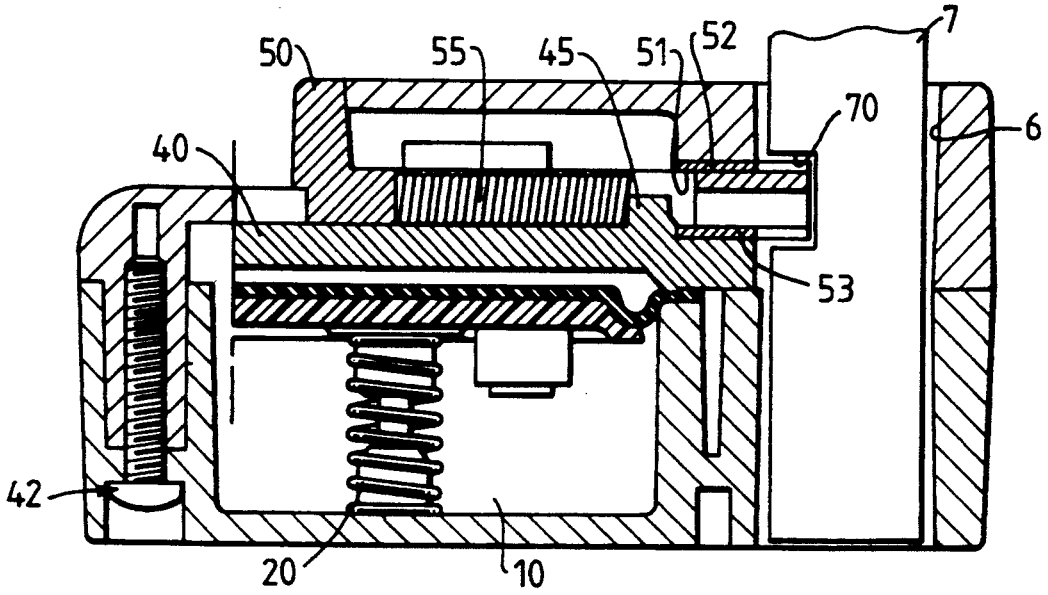
FIG. 5 is a sectional side elevation along the line V—V of FIG. 1.

The diaphragm assembly 13 is secured to the upper edge of the chamber 10 by means of a cover plate 40 of a rigid plastics material. The cover plate 40 engages the upper surface of the diaphragm plate 14 where it overlaps the upper edge of the wall of the chamber 10, the cover plate being trapped under the upper moulding 3 so that the edge of the diaphragm plate is compressed against the lower moulding to produce a gas-tight seal. The cover plate 40 has a central aperture 41 through which the retaining member 19 projects, as a sliding fit. The upper moulding 3 is retained with the lower moulding 4 by means of four screws 42, only one of which is shown (FIG. 5). As shown in FIG. 4, the cover plate 40 and the upper moulding 3 have apertures 43 and 33 respectively by which gas and water can flow to and from the upper surface of the diaphragm assembly 13. The apertures 43 and 33 are located away from the plug 30, so that the plug is protected from direct contact with contaminants that might enter the casing 2 through the apertures.

The assembly also includes a rigid, moulded, plastics slider 50 of elongate rectangular shape extending horizontally in contact with the upper surface of the cover plate 40. At its right-hand end, the slider 50 projects through an opening 51 in the upper moulding 3 into the aperture 6, so that the end of the slider engages a notch 70 in the bolt 7 and thereby provides a catch preventing withdrawal of the bolt from the aperture. Two stainless steel shim plates 52 and 53 are located in the opening 51 above and below the slider 50. The purpose of these plates is to ensure free movement of the slider 50 since, otherwise, plasticizer in the cover plate 40 and upper moulding 3 could migrate into the slider and cause adhesion.

Figure 6:
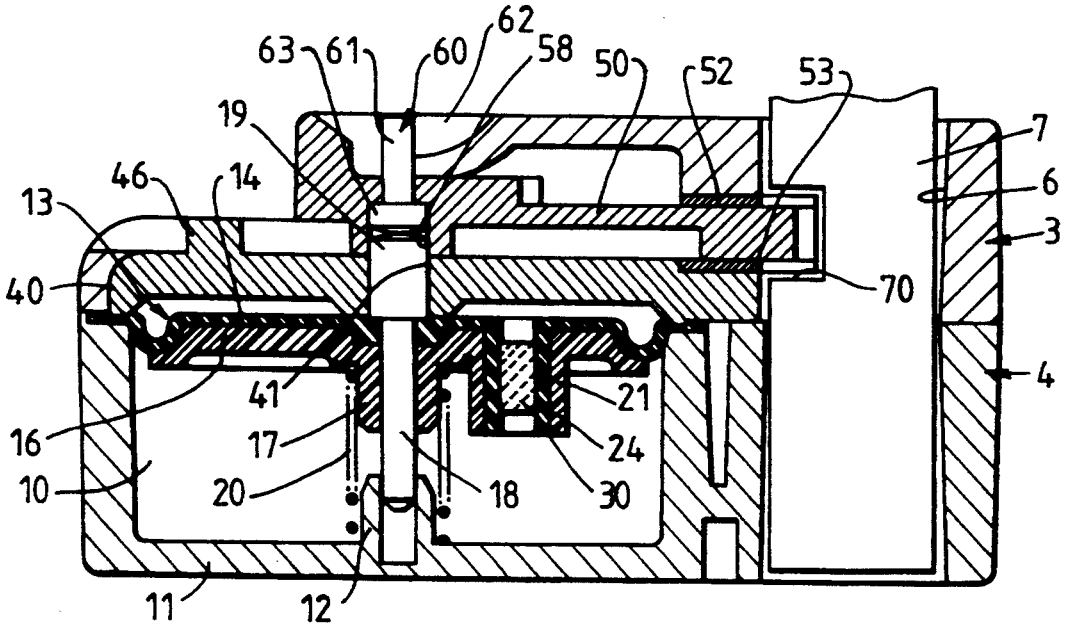
FIG. 6 is a sectional side elevation along the line VI—VI of FIG. 1.

Two helical springs 54 and 55 extend side-by-side in channels 56 and 57 formed on the underside of the slider 50 and are held in compression by engagement at their lea-hand ends with the ends of the channels, and at their right-hand ends by engagement with respective projections 44 and 45 from the upper surface of the cover plate 40. Towards its left-hand end, the slider 50 has an aperture 58 that, in the first, locked position shown in FIGS. 5 and 6, aligns with the aperture 41 in the cover plate 40 and that receives the upper end of the retaining member 19 as a sliding fit. The upper end of the aperture 58 has a reduced diameter and retains a manual actuator or push button 60. The push button 60 has a vertical stem 61, square in section, which projects upwardly from the slider 50 into a narrow slot 62 in the upper moulding 3. The lower end 63 of the button 60 is of circular section with an enlarged diameter and is located in the lower, wider part of the aperture 58. On its lower end the button 60 has a domed, convex surface 64 abutting the upper end of the retaining member 19, which extends into the lower end of the aperture 58 in the slider 50. The slider 50 is retained in this first position, against the action of the springs 54 and 55 by engagement of the retaining member 19 in the aperture 58 in the slider 50, since the spring 20 in the chamber 10 urges the diaphragm assembly upwardly.

In normal operation, the assembly remains in its locked state described above. The pressure-equalizing plug 30 allows gas to flow gradually into and out of the chamber 10 so that normal changes in atmospheric pressure or, for example, pressure changes caused by air transportation prior to installation, will not cause any significant pressure differential across the diaphragm plate 14. If, however the vessel carrying the release assembly should sink, water or trapped air will pass through the apertures 33 and 43 into contact with the upper surface of the diaphragm assembly 13. This causes an increase in pressure on the upper side of the diaphragm assembly 13 which is too rapid to be equalized by the plug 30. Furthermore, if the plug were contacted by water, this would only permeate through the plug at a very much slower rate than air. When the vessel sinks below about 2 m, the differential pressure across the diaphragm plate 14 becomes sufficient to deflect it down, against the action of the spring 20 and overcoming friction between the rod 18 and its contacting components. The triggering depth can be altered by using different springs, the maximum depth at which triggering occurs preferably being 4 m. As the diaphragm plate 14 moves down along an axis normal to its plane, it also displaces the rod 18 down along its axis until the upper end of the retaining member 19 is level with the lower end of the aperture 58 in the slider 50. When this happens, there is nothing to retain the slider 50 in position so it is free to move to the left, in a plane transverse to the axis of displacement of the diaphragm plate 14, under the action of the springs 54 and 55, until it comes into contact with a stop 46 on the upper surface of the cover plate 40, as shown in FIG. 7. In this second, released position, the right-hand end of the slider 50 is located outside the aperture 6 so that it no longer retains the bolt 7 in position. The retaining member 19 and diaphragm plate 14 are held down, in this second position, by the underside of the slider 50, as long as the slider is in its second, released position. The item of safety equipment held by the bolt 7 is now free to float to the water surface by its own buoyancy.

The release assembly 1 has the advantage that it can be actuated and reset manually by means of the push button 60. If the button 60 were depressed when the assembly was in its locked position, the retaining member 19 and diaphragm assembly 13 would both be pushed down against the action of the spring 20 and compression of the air trapped in the chamber 10 until the upper end of the retaining member 19 became level with the lower end of the aperture 58 in the slider 50. The slider 50 would then be displaced to the left by its springs 54 and 55. This can be used to test for free movement of the slider 50 or to enable removal of the bolt 7 so that the associated safety equipment can easily be removed for repair, inspection or maintenance. The slot 62 in the upper moulding 3 protects the button 60 from accidental actuation, so that a coin or something similar must be pushed into the slot before the button can be pushed down.

The slider need not be displaceable along its length, as in the assembly described above, but could be rotatable in a plane transverse to the axis of displacement of the diaphragm.

Locating the pressure-equalizing vent 30 on the diaphragm itself has advantages over previous assemblies in which the vent projects through the casing of the pressure sensing chamber and is exposed on the outside of the assembly. In the present arrangement, the vent plug 30 is protected from contamination by grease, paint etc by the cover plate 40, the slider 50 and the upper moulding 3, although there must still be a fluid flow path between the plug and the outside. It is not, however, essential that the plug be located on the diaphragm. The plug could be located in an outer wall of the chamber using a resilient sleeve, similar to the sleeve 24 on the diaphragm, which extends through a hole in the wall of the chamber.

The release assembly of the present invention is not confined to use with a releasable bolt of the kind described but could be modified to employ a knife that cuts a rope, web or the like. In such an assembly, the slider could have an aperture that aligns with the aperture in the casing through which the rope extends, the aperture in the slider having a knife edge around a part at least of its circumference, facing the direction in which the slider moves on release. Thus, when the assembly is triggered on sinking, the slider is displaced and the rope is cut. In such an arrangement there is less advantage to providing manual actuation, since this will result in severing of the rope which may not be desirable. However, if the rope is removed first, the manual actuation enables free movement of the slider to be tested. Also, the mounting of the pressure-equalizing vent can have advantages with a rope cutting assembly.

What I claim is:

1. A pressure-responsive device comprising:

an outer casing;

a chamber within the casing;

a flexible diaphragm sealing the chamber on one side and exposed to pressure externally of the device on its opposite side;

a pressure-equalizing vent including a rigid cylindrical plug that is porous to gas and positioned to allow gradual equalization of gas pressure between the chamber and an external environment;

a hole through a wall of the chamber;

and a sleeve extending around the plug and within the hole to retain the plug in the hole, the sleeve being of a rubber-like material that is substantially more resilient than both the wall of the chamber and the plug.

2. A pressure-responsive device according to claim 1, wherein the said wall is the diaphragm and the said hole is a hole through the diaphragm, and wherein the vent is mounted on the diaphragm so that it is protected by the outer casing.

3. A pressure-responsive device according to claim 2, wherein the resilient sleeve is a part of the diaphragm.

4. A pressure-responsive device according to claim 2, wherein the diaphragm comprises a resilient plate and a rigid disc mounted on the resilient plate.

5. A pressure-responsive device according to claim 4, wherein the disc is formed with a projecting collar, and wherein the resilient sleeve extends within the collar.

6. A pressure-responsive device according to claim 5, wherein the sleeve has an internal annular bead at opposite ends.

7. A pressure-responsive device according to claim 1, wherein the resilient sleeve is formed with a closed end that is cut off after it has been pulled through the hole.

8. A pressure-responsive device according to claim 1 wherein the rigid plug is of a ceramic material.

9. A pressure-responsive device comprising: an outer casing; a chamber within the casing; a flexible diaphragm sealing the chamber on one side and exposed to pressure externally of the casing on its opposite side such that a sudden change in external pressure causes deflection of the diaphragm from a first diaphragm position to a second diaphragm position along an axis normal to the diaphragm; a slider that is displaceable in a plane transverse to said axis, said slider having an aperture therethrough; a retaining rod projecting from the diaphragm into the aperture from one side for retaining the slider in a first slider position while the diaphragm is in the first diaphragm position; means for urging the slider to a second slider position different from the first slider position, the retaining rod being operable to release the slider for displacement to the second slider position when the diaphragm is displaced to the second diaphragm position; and a manually-actuable button separate from the rod that projects into the aperture from the other side into abutment with the rod and that is operable to displace the retaining rod to allow the slider to move to the second slider position.

* * * * *